United States Patent [19]

Palsson

[11] Patent Number: 4,647,093

[45] Date of Patent: Mar. 3, 1987

[54] SAFETY LATCH ASSEMBLY

[76] Inventor: Johannes S. Palsson, Taastrupgaardsvej 177, DK-2630 Taastrup, Denmark

[21] Appl. No.: 763,138

[22] PCT Filed: Nov. 27, 1984

[86] PCT No.: PCT/DK84/00115

§ 371 Date: Jul. 25, 1985

§ 102(e) Date: Jul. 25, 1985

[87] PCT Pub. No.: WO85/02437

PCT Pub. Date: Jun. 6, 1985

[30] Foreign Application Priority Data

Nov. 28, 1983 [DK] Denmark ..... 5441/83

[51] Int. Cl.[4] ..... E05C 5/04

[52] U.S. Cl. ..... 292/251; 292/209; 292/DIG. 38; 292/DIG. 65

[58] Field of Search ..... 292/107, 212, 206–210, 292/251, 347, 336.3, 256.71, DIG. 65, DIG. 38, 356, 359, 241; 70/166–173, 210; 215/216, 221; 220/302

[56] References Cited

U.S. PATENT DOCUMENTS

| | | | |
|---|---|---|---|
| 2,468,646 | 4/1949 | Verhoff | 292/251 |
| 3,338,613 | 8/1967 | Kendrick | 292/347 |
| 3,567,263 | 3/1971 | McKinney | 292/241 |
| 3,652,112 | 3/1972 | Panelli | 292/241 X |
| 3,844,438 | 10/1974 | St. Pierre et al. | 215/221 |
| 3,858,740 | 1/1975 | Lestaevel | 215/216 |
| 3,917,097 | 11/1975 | Uhlig | 215/216 |
| 4,055,361 | 10/1977 | Moses | 292/359 |
| 4,216,985 | 8/1980 | Sorensen | 292/359 X |
| 4,427,124 | 1/1984 | Marshall et al. | 215/216 |

FOREIGN PATENT DOCUMENTS

| | | | |
|---|---|---|---|
| 2536987 | 3/1977 | Fed. Rep. of Germany . | |
| 2940678 | 4/1980 | Fed. Rep. of Germany . | |
| 3129674 | 7/1984 | Fed. Rep. of Germany . | |
| 436351 | 1/1912 | France | 70/210 |
| 427762 | 5/1983 | Sweden . | |
| 779294 | 7/1957 | United Kingdom . | |
| 1582667 | 1/1981 | United Kingdom | 292/336.3 |

*Primary Examiner*—Robert L. Wolfe
*Assistant Examiner*—Russell W. Illich
*Attorney, Agent, or Firm*—Holman & Stern

[57] ABSTRACT

A safety latch assembly has a rotatable grip rotatably mounted on a stationary handle and a ring-shaped flange surrounding a substantially cylindrical portion of the stationary handle, an elastically resilient arresting means on the cylindrical portion whose exterior is formed with an arresting face with which a stop face on the inner side of the grip flange engages upon rotation of the grip in the opening direction from the closed position when the arresting means is in the normal position. The grip is arranged so that the arresting means can be actuated through the flange of the grip to disengage the arresting face from the stop face.

11 Claims, 5 Drawing Figures

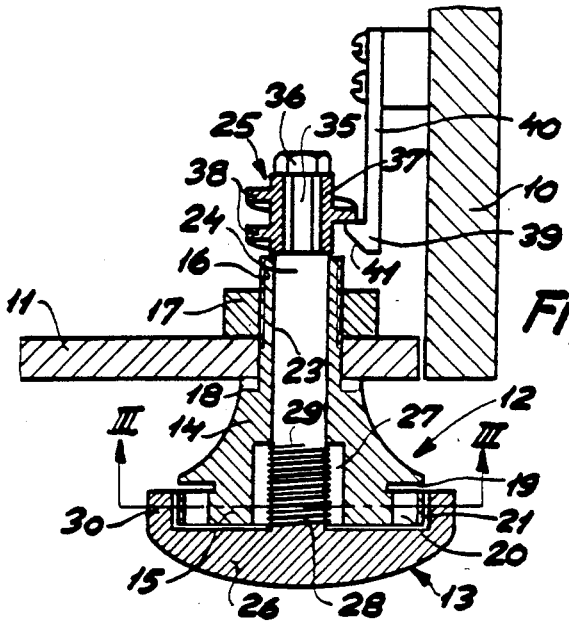
Fig.1
Fig.2
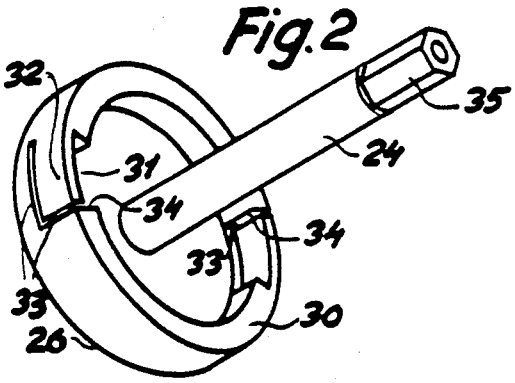
Fig.3
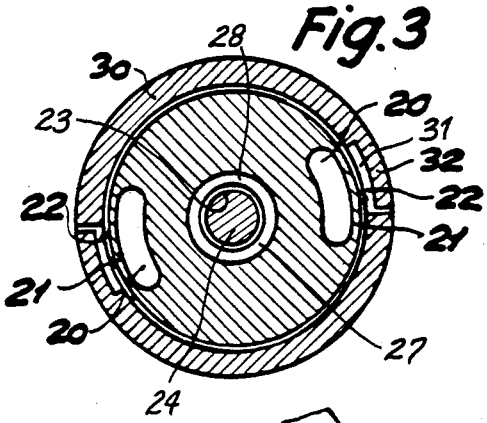
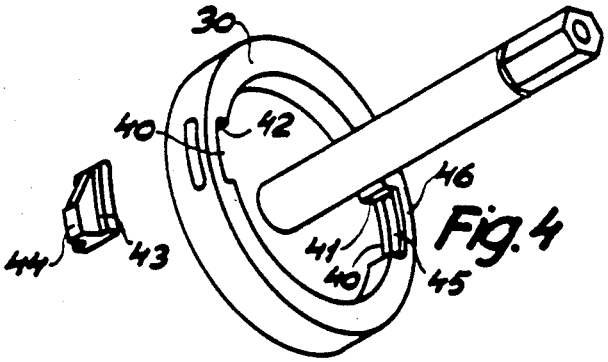
Fig.4
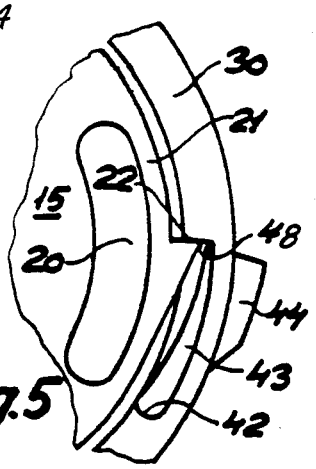
Fig.5

SAFETY LATCH ASSEMBLY

CROSS REFERENCE TO RELATED APPLICATION

This United States application stems from PCT International Application No. PCT/DK84/0015 filed Nov. 27, 1984.

BACKGROUND OF THE INVENTION

1. Field of the Invention

The invention relates to a safety door latch assembly of the type containing a rotatable grip with a ring-shaped flange surrounding a substantially cylindrical portion of a stationary handle element having an elastically resilient arresting means whose exterior is formed with an arresting face which a stop face on the inner side of the grip flange will engage upon rotation of the grip in the opening direction from the closed position when the arresting means is in an unaffected position, the grip being so arranged that the arresting means can be actuated through the flange of the grip to disengage the arresting face from the stop face .

2. Description of the Prior Art

In the Danish Patent Application No. 2961/83 such a safety closure is shown and described for medicine bottles and similar containers containing substances which may be dangerous to children.

BRIEF SUMMARY OF THE INVENTION

The invention is based on the finding that it may be desirable to protect not only individual medicine containers, but also cabinet compartments in which such containers and other objects dangerous to children, such as razor blades and pointed scissors, are kept, and the present safety latch assembly can be used for this purpose without difficulty.

Accordingly, the safety latch assembly of the invention is characterized in that it is mounted on a cabinet with a door so as to prevent and allow, respectively, opening of the door in two different rotary positions of the grip.

This use permits the elastically resilient arresting means to be provided in a particularly expedient manner.

Another expedient detail is an embodiment of the latch assembly in which the arresting means, instead of being actuated by a thin-walled portion of the ring-shaped flange of the grip, is actuated by a special actuation means. The actuation means may be directly accessible from the outside.

In another embodiment of the locking mechanism itself, the latch assembly may be reclosed after having been opened, without the grip having to be rotated back to its starting position.

Further embodiments of the turn latch enable the door to be clamped somewhat upon rotation of the grip, and provide for snap-closing of the latch assembly irrespective of the rotary position of the grip.

BRIEF DESCRIPTION OF THE DRAWINGS

The invention will be explained more fully below with reference to the accompanying drawing, wherein FIG. 1 is a cross-sectional view through a portion of a cabinet wall and a hinged cabinet door fitted with an embodiment of the safety latch assembly of the invention;

FIG. 2 is a perspective view of the grip of the latch assembly;

FIG. 3 is a cross-sectional view taken along the line III—III in FIG. 1;

FIG. 4 is a perspective view of the grip for another embodiment of the latch assembly of the invention; and FIG. 5 is an enlarged cross-sectional view of parts of the grip and stationary element of this closure with the arresting means of the grip in blocking engagement with the stop face of the stationary element.

DETAILED DESCRIPTION

In FIG. 1, the numeral 10 designates a side wall in a cabinet for the storage of medicine or other objects which may be dangerous to children, and the numeral 11 designates a door which is hinged at one side edge (not shown) and whose shown side edge mounts a safety latch assembly of the invention. This latch assembly has a stationary closing element generally designated 12 and a rotary closing element generally designated 13.

The stationary closing element 12 is formed by a body of revolution, which preferably consists of a suitable plastics material which is relatively rigid and hard while possessing some elasticity. The closing element 12 has a head disposed on the outer side of the door and formed with a substantially frusto-conical inner portion 14 and a substantially cylindrical outer portion 15. The element 12 has moreover a stem 16 extending through a hole in the door. This stem, which is threaded, mounts a nut 17, by means of which the stationary element 12 is fixed to the door 11. At the foot of the stem 16 the end face of the substantially frusto-conical portion 14 has a ring-shaped groove in which a sealing ring 18 may be disposed.

The two portions 14 and 15 of the head of the stationary element 12 are partly spaced from each other by an annular narrow groove 19, which is disposed in a radial plane and extends from the periphery a distance into the head. The substantially cylindrical portion 15 is formed with two diametrically opposite, arc-shaped axially through-going slots 20 in the region defined by the groove 19; these slots 20 each extend along a portion of the peripheral area of part 15 and are outwardly defined by a relatively thin strip of material 21, which is formed at the middle of its exterior with an arresting face 22 disposed in an axial plane and which forms an elastically resilient arresting means.

The stationary element 12 has moreover an axially extending through-going central hole 23 which rotatably mounts a shaft 24 forming the rotary closure element together with a turn latch 25 firmly mounted on said shaft and a substantially disc-shaped grip 26. The outermost portion of the central hole has a greater diameter than the remaining portion so as to provide an annular space 27 around the shaft 24 to receive a helical spring 28, which surrounds the shaft 24 and whose one end is attached thereto, while the other end portion 29 is bent outwardly and so engages the wall defining the space 27 as to form a pawl which allows rotation of the rotary element 13 in one direction, but essentially prevents rotation in the opposite direction.

The grip 26 has a ring-shaped, cylindrical edge flange 30 enclosing the substantially cylindrical portion 15 of the stationary element 12. The edge flange 30 is formed with a recess 31 on two diametrically opposite points on the inner side, said recess 31 extending along a portion of the periphery and a distance in an axial direction from the free edge of the flange. The thin wall portion 32 defined by each recess 31 is separated from the rest of the flange by two cuts 33, one of which extends axially and, the other of which extends circumferentially so that this wall portion forms a resilient tongue. The end face 34 of the recess 31 disposed at the free end of this tongue forms a stop face for cooperation with the arresting faces 22 on the arresting means 21 of the stationary closure element.

The free end portion 35 of the shaft 24 has a hexagonal cross-section, and the turn latch 25 is secured to this end portion, as mentioned previously, e.g. as shown by means of a screw 36 screwed into a threaded hole in the end of the shaft 24. The turn latch 25 has a hub portion 37 and two helicoidally shaped latch elements 38 staggered from each other, each said latch element extending through approximately 180° of the periphery of the hub portion. The turn latch 25 cooperates with a locking hook or catch 39 on a spring 40 which is attached to the inner side of the cabinet side wall 10. The locking hook 39 is defined at one side by an inclined cam edge 41.

In FIG. 1 the door 11 is shown in its closed position and retained in this position as one latch element 38 is disposed behind and arrested against movement in the opening direction of the door by the locking hook 39. Canceling of this arrest requires turning of the latch 25 until one end edge of the latch element 38 has passed the locking hook 39. However, upon rotation of the grip 26, the stop faces 34 of the grip will be engaged by the arresting faces 22 on the arresting means 21 of the stationary element as shown in FIG. 3, thus preventing further rotation. The locking engagement thus established between the stop faces 34 and the arresting faces 22 can now be released by an external pressure in the inward direction of the elastic tongues 32 of the grip which thus press the arresting faces 22 of the arresting means 21 out of contact with the stop faces 34. The grip 26 can then be rotated freely until the active latch element of the turn latch 25 clears the locking hook 39 and thus allows opening of the door 11. Closing of the door can be effected by pressure alone as the locking hook 39 will then be pressed aside by one latch element 38 owing to the cam effect between said element and the cam edge 41 of the locking hook. When the latch element has passed the locking hook, the spring 40 snaps it back to the shown locking position.

The rotary latch assembly shown in FIGS. 4 and 5, like the one shown in FIGS. 1-3, has a cylindrical flange 30 with two diameterically opposite recesses in the inner side. These recesses are here designated 40 and are defined at one end by a substantially axially extending wall 48 forming a stop face and at the other end by a curved wall 42 forming a hinge bearing for one end edge of an actuation means formed as a curved plate 43; the actuation means has on its outer side a rib 44 which protrudes through a slot 45 in the thin flange wall portion 46 defined by the recess when the actuation means is positioned in the rotary closure part as shown in FIG. 5. In this figure the parts are shown in their blocking position with the arresting face 22 in engagement with the stop face 48. It will be seen that the blocking can be released by application of pressure on the protruding portion of the ridge 44 of the actuation means, causing said means to pivot about its hinge bearing 42 and pressing the arresting face 22 inwardly past the edge of the stop face 48 so that the rotary closure element can then be freely rotated to open the safety latch assembly.

The details of the safety latch assembly of the invention can be formed in many other ways than those shown in the drawing and described in the foregoing, and the latch assembly may also be used in other connections, e.g. in connection with slide doors.

I claim:

1. A safety latch assembly for a cabinet door which prevents and allows opening of the door in two different rotational positions of a rotatable grip on the latch assembly, respectively, comprising:

a stationary handle element;

a substantially cylindrical portion on said handle element;

an elastic resilient arresting means on said cylindrical portion having an outer surface;

an arresting face on said outer surface of said arresting means;

a rotatable grip rotatably mounted for rotation between latching and unlatching positions;

an annular flange on said rotatable grip surrounding said substantially cylindrical portion of said arresting means and having an inner side;

a recess in said annular flange having opposite edges;

a stop face on said inner side formed by one of said opposite edges of said recess engageable with said arresting face, said arresting means being displaceable in said recess;

a depression on the other of said opposite edges forming a bearing surface; and a pivotable actuation means engaging said bearing surface for pivotable movement with respect to said annular flange and engageable with said arresting means, so that rotation of said grip in the unlatching direction is prevented by engagement of said stop face with said arresting face when said arresting means is in a normal position and actuation of said actuation means releases said arresting means by disengaging said arresting and stop faces to allow rotation of said grip into the unlatching position.

2. A safety latch assembly as claimed in claim 1 and further comprising:

a thin wall portion on said annular flange defining an outer extremity of said recess;

a hole in said thin wall portion; and a protruding portion on said actuation means protruding through said hole.

3. A safety latch assembly for a cabinet door which prevents and allows opening of the door in two different rotational positions of a rotatable grip on the latch assembly, respectively, comprising:

a stationary handle element;

a substantially cylindrical portion on said handle element;

an elastic resilient arresting means on said cylindrical portion having an outer surface;

an arresting face on said outer surface of said arresting means;

a rotatable grip;

a shaft on said rotatable grip extending rotatably through said stationary element and having an inner end thereon, said shaft rotatably mounting said grip for rotation between latching and unlatching positions;

an annular flange on said rotatable grip surrounding said substantially cylindrical portion of said arresting means and having an inner side;

a recess in said annular flange having opposite edges;

a stop face on said inner side formed by one of said opposite edges of said recess engageable with said arresting face, said arresting means being displaceable in said recess;

a stationary catch means mounted adjacent said inner end of said shaft in the latching position; and a turn latch mounted on said inner end of said shaft engageable with said catch means when said rotatable grip is in the latching position and disengageable from said catch means when said rotatable grip is in the unlatching position.

4. A safety latch assembly as claimed in claim 3 wherein said stationary catch means comprises:

an elastically resilient mounting member;

a locking hook having a turn latch engaging surface for engaging with said turn latch in said latching position; and a cam face on said locking hook engageable with said turn latch during movement of said latch assembly toward said catch means so that said locking hook will be cammed away from said turn latch until said engaging surface is in position for engaging said turn latch in said latching position.

5. A safety latch assembly as claimed in claim 3 wherein said turn latch comprises:

a hub portion mounted on said inner end of said shaft; and a helical rib portion extending from said hub portion.

6. A safety latch assembly as claimed in claim 4 wherein said turn latch comprises:

a hub portion mounted on said inner end of said shaft; and a helical rib portion extending from said hub portion.

7. A safety latch assembly as claimed in claim 5 wherein:

said helical rib portion comprises two axially spaced ribs each extending through appoximately 180° and being staggered with respect to each other.

8. A safety latch assembly as claimed in claim 6 wherein:

said helical rib portion comprises two axially spaced ribs each extending through approximately 180° and being staggered with respect to each other.

9. A safety latch assembly comprising:

a stationary handle element having mounting means thereon for mounting said handle stationarily on a first member;

a substantially cylindrical portion on said handle element;

an elastic resilient arresting means on said cylindrical portion having an outer surface;

an arresting face on said outer surface of said arresting means;

a rotatable grip rotatably mounted on said handle element;

an annular flange on said rotatable grip surrounding said substantially cylindrical portion of said arresting means and having an inner side;

a recess in said annular flange having opposite edges;

a stop face on said inner side formed by one of said opposite edges of said recess engageable with said arresting face for preventing rotation of said rotatable grip in one direction, said arresting means being displaceable in said recess;

a stationary catch means for mounting on a second member, said first and second members being relatively movable with respect to each other between latching and unlatching positions;

a turn latch mounted on said rotatable grip to be rotatable therewith releasably engageable with said stationary catch means by rotation of said rotatable grip when said first and second members are in said latching position; and actuating means on said annular flange engageable with said arresting means for disengaging said arresting and stop faces to allow rotation of said rotatable grip upon actuation of said actuating means.

10. A safety latch assembly as claimed in claim 9 wherein:

said arresting means is formed by an arc-shaped slot extending along a portion of the peripheral area of said substantially cylindrical portion.

11. A safety latch assembly as claimed in claim 10 wherein:

said substantially cylindrical portion is defined in one axial direction by an annular groove in said stationary handle element.

* * * * *